US005400977A

United States Patent [19]

Hayles, Jr.

[11] Patent Number: 5,400,977

[45] Date of Patent: Mar. 28, 1995

[54] PULVERIZER

[76] Inventor: Peter E. Hayles, Jr., 225 Grover Rd., Toms River, N.J. 08753

[21] Appl. No.: 170,056

[22] Filed: Dec. 20, 1993

[51] Int. Cl.[6] ..... B02C 13/04

[52] U.S. Cl. ..... 241/154; 241/161; 241/187; 241/188.1; 241/190; 241/46.11

[58] Field of Search ..... 241/46.11, 154, 155, 241/161, 162, 163, 187, 188.1, 189.1, 190, 236, 275

[56] References Cited

U.S. PATENT DOCUMENTS

| | | | |
|---|---|---|---|
| 310,940 | 1/1885 | Gould . | |
| 315,064 | 4/1885 | Pratt . | |
| 345,408 | 7/1886 | Birge | 241/187 X |
| 359,630 | 3/1887 | Pratt . | |
| 410,247 | 9/1889 | Kimble | 271/187 X |
| 500,582 | 7/1893 | Jones | 241/187 X |
| 666,404 | 1/1901 | Wurster . | |
| 1,006,573 | 10/1911 | Lockwood | 271/187 X |
| 1,038,886 | 9/1912 | Hirt | 241/188.1 X |
| 1,457,693 | 6/1923 | Dorn | 241/187 X |
| 1,977,501 | 10/1934 | Townsend | 241/154 X |
| 2,049,920 | 8/1936 | McNitt . | |
| 2,774,543 | 12/1956 | Keller et al. | 241/187 X |
| 3,696,817 | 10/1972 | Bonner, Jr. et al. | 241/154 X |
| 3,927,840 | 12/1975 | Nash . | |
| 3,931,936 | 1/1976 | Petry et al. . | |
| 4,082,231 | 4/1978 | Gould | 241/187 |
| 4,166,583 | 9/1979 | Ruckstuhl | 241/187 X |
| 4,947,906 | 8/1990 | Schroeder . | |

*Primary Examiner*—Timothy V. Eley

[57] ABSTRACT

A pulverizing system which reduces the size of solid particulate material such as drill cuttings from a wellbore is disclosed. The pulverizing system includes a pair of interconnected cylindrical chambers with each chamber having a rotatable shaft with a plurality of disc sets mounted thereon. The shafts are aligned in parallel relation and operate in a counter rotating manner. Each disc set includes at least one pivotally mounted thrust guide in the form of a bar shaped member. In one embodiment, the thrust guides of the two shafts are arranged in an alternating, interdigitating pattern. The chambers are divided by transverse baffle walls into compartments, with each baffle wall having an opening therein for passage of the particulate material.

11 Claims, 4 Drawing Sheets

PULVERIZER

BACKGROUND OF THE INVENTION

The present invention is related to a pulverizer, and more particularly to a pulverizer device having the capability to receive material in a slurry condition such as drill cuttings from a wellbore and to break the material down to a reduced particle size for further use such as by reinjection of the refined cuttings down a wellbore.

The disposal of drill cuttings has been a longstanding problem in the field of well drilling and this problem has recently received attention due to increased concern regarding the environment. Offshore drilling operations, in particular, are problematic because the transport of the cuttings to a landfill or a shore-based processing system is required.

One solution to this problem is disclosed in U.S. Pat. Nos. 5,109,933 and 5,129,469. The prior art system for disposing of drill cuttings as described in these patents involves mixing the cuttings with a carrier liquid such as water, and reducing the size of the cuttings in a pump having an impeller of a backward swept blade type to form a slurry of the particles and the carrier liquid for injection into a well for disposal.

Other types of pulverizers and material breaking machinery are described, for example, in the following U.S. Pat. Nos.: 310,940 to Gould; 315,064 to Pratt; 345,408 to Birge; 359,630 to Pratt; 666,404 to Wurster; 2,049,920 to McNitt; 3,927,840 to Nash; 3,931,936 to Petry et al.; and 4,947,906 to Schroeder.

SUMMARY OF THE INVENTION

The present invention provides an improved apparatus and method for processing drill cuttings and reducing the particle size of such drill cuttings through the use of a pulverizer before the cuttings are reinjected into the wellbore.

It is thus one object of the present invention to provide a new apparatus and process for disposing of drill cuttings from a wellbore, wherein a pulverizer having improved features is employed to reduce the size of the particulate solid materials in the drill cuttings sufficiently so that they may be sent back to be reinjected into the wellbore.

It is another object of the present invention to provide a pulverizer for use in a drill cuttings disposal system wherein one pass of the cuttings through the pulverizer is sufficient to reduce the cuttings to the appropriate size.

It is a further object of the present invention to provide a pulverizer for use in a drill cuttings disposal system having parallel, counter-rotating shafts wherein a plurality of pivotally mounted thrust guides alternately interdigitate or intermesh to facilitate the breakup of the drill cuttings into smaller particles as the particles collide with each other while passing through the system.

It is still another object of the present invention to provide a pulverizer for use in a drill cuttings disposal system wherein the pulverizer is segmented along the length thereof by baffles which have staggered openings through which the cuttings flow.

It is a further object of the present invention to provide a pulverizer which may be advantageously employed in pulverizing various materials, such as drill cuttings, agricultural products and various types of minerals.

DESCRIPTION OF THE PREFERRED EMBODIMENTS

Figure 1:
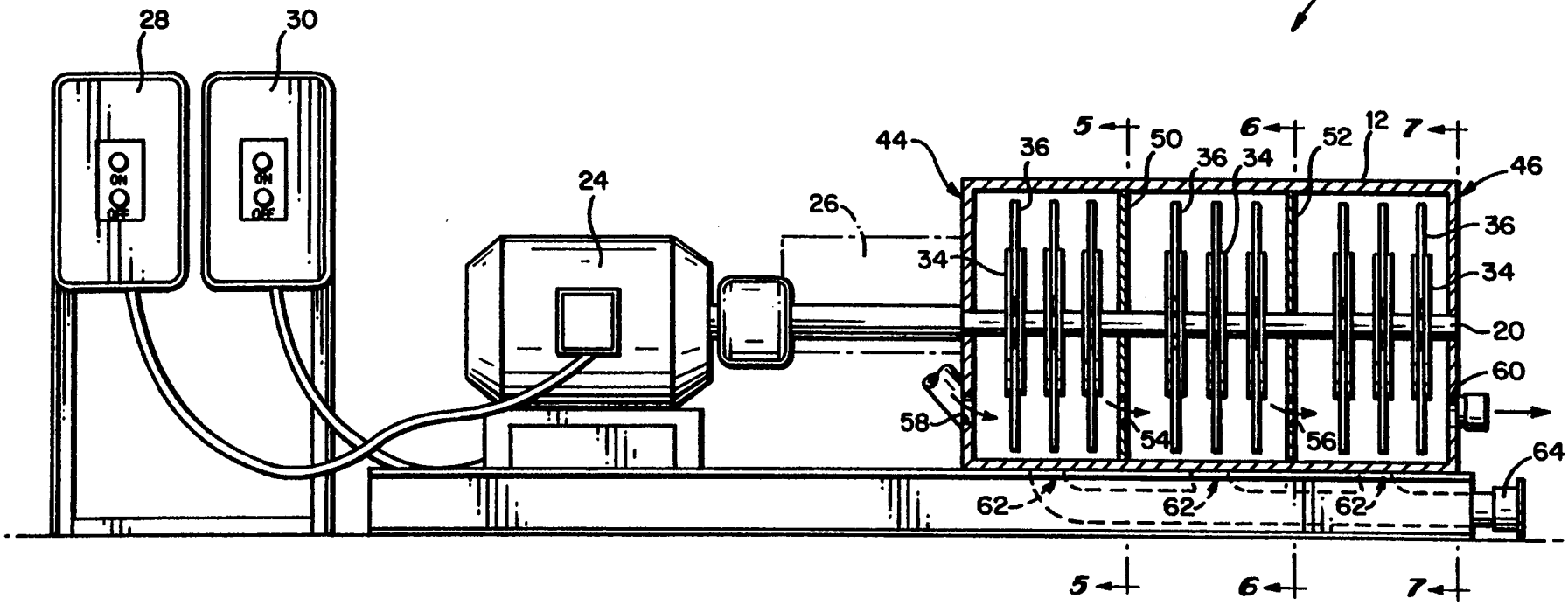
FIG. 1 is a side elevation view showing the pulverizer system of the present invention.
Figure 2:
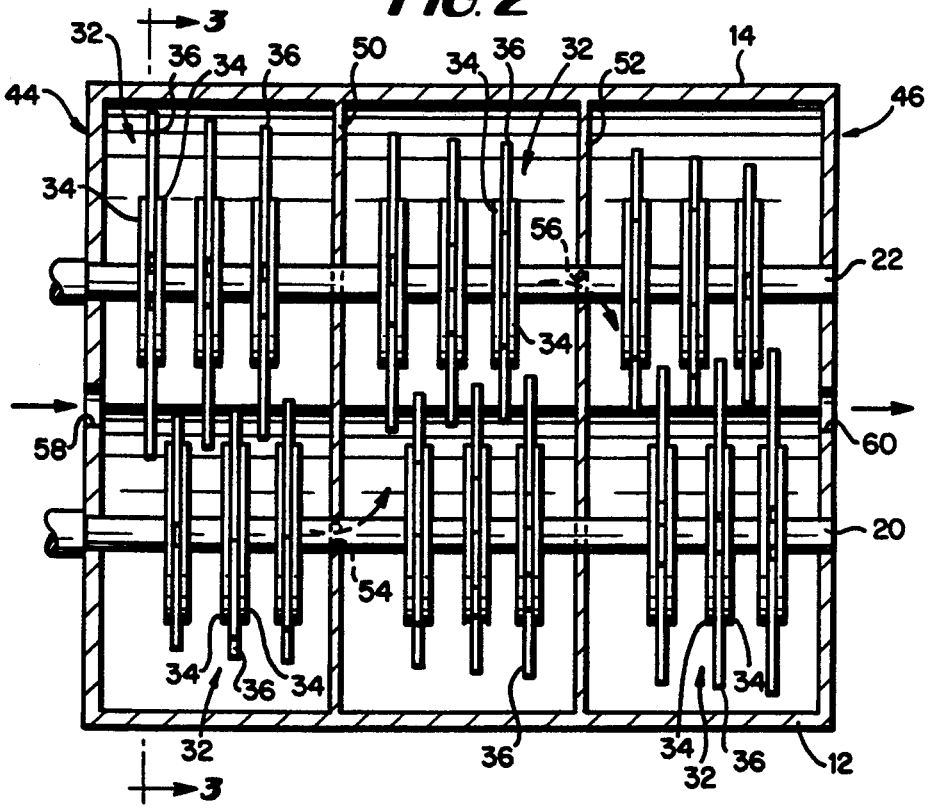
FIG. 2 is a top plan view in partial cross section of the interior of the pulverizer of the present invention showing the pulverizer in operation.
Figure 3:
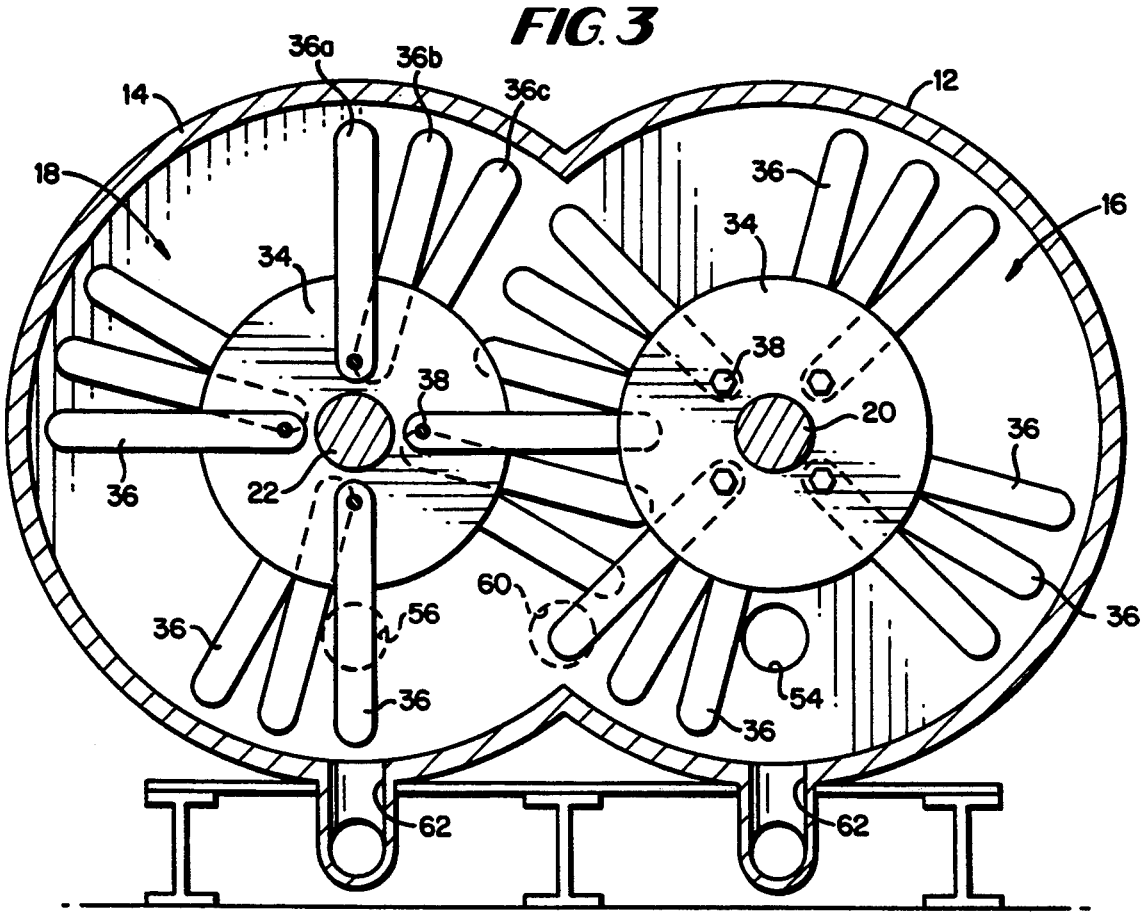
FIG. 3 is an end view of the pulverizer taken along line 3—3 in FIG. 2, showing the pivoting movement of the thrust guides during operation.

In the embodiment of the present invention as shown in FIGS. 1 through 7, there is provided a pulverizer 10 formed by a pair of overlapping cylindrical tanks 12, 14 having a figure-eight shape in cross section, thus providing respective tank chambers 16, 18 which are in fluid communication, as shown in FIG. 3. Each tank 12, 14 has a respective shaft 20, 22 mounted axially therein, so that the shafts 20, 22 extend in parallel relation throughout the length of the tanks 12, 14. Each shaft 20, 22 is rotatably mounted for operation by a respective motor 24, with each motor 24 being controlled through a separate control breaker panel 28, 30. The shafts 20, 22 are freely rotatable in either direction and during operation of the pulverizer 10, the shafts 20, 22 will rotate in opposite or counter rotating directions with respect to each other. A safety cage 26 is mounted above the inlet end of the tanks 12, 14.

Figure 4:
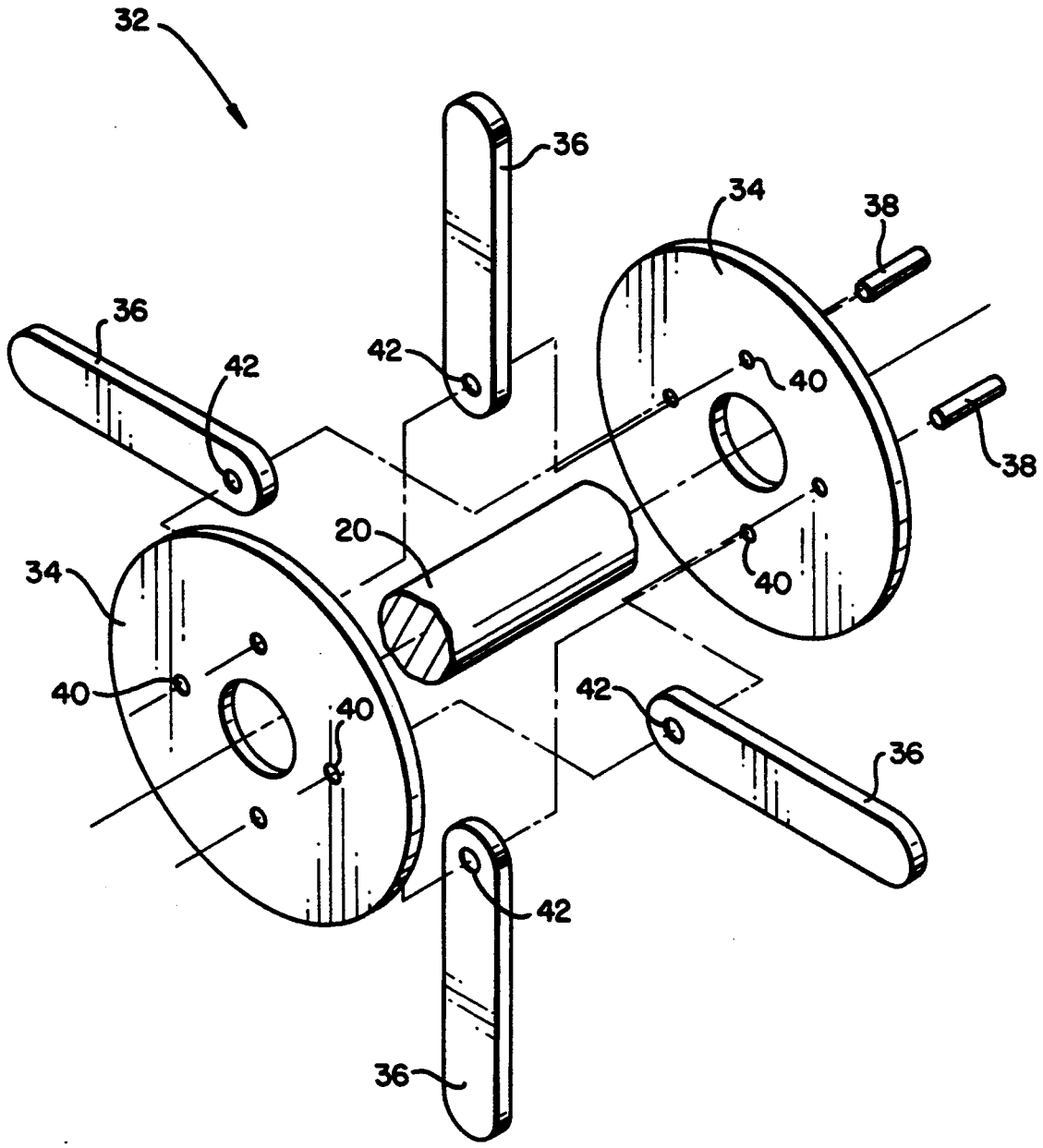
FIG. 4 is an exploded perspective view of the thrust guide and disc assembly employed in the pulverizer of FIG. 1.

A plurality of disc sets 32 are mounted at spaced intervals along the length of each shaft 20, 22, as shown in FIGS. 1 and 2. In FIG. 1, only the disc sets 32 of tank 12 are shown for purposes of clarity and these are shown in schematic form. Each disc set 32 includes a pair of discs 34 which are welded or otherwise secured to a respective shaft 20, 22, and with one or more thrust guides 36 pivotally mounted between each pair of discs 34 by the use of pins or bolts 38 which pass through holes 40 and 42 in the discs 34 and thrust guides 36, respectively, as shown in FIG. 4. It is also within the scope of the invention for the thrust guides to be pivotally mounted on a single disc rather than between a pair of discs.

The thrust guides 36 are in the form of elongated bars having outer ends which may be of either chamfered or rectangular shape in cross section. In the embodiment as shown in FIGS. 2 and 3, four thrust guides 36 are pivotally mounted at equal intervals around the circumference of the disc sets 32. The amount by which the thrust guides 36 extend outwardly beyond the discs 34 may be varied by changing the length of the guides 36 or by changing the location at which the thrust guides 36 are pivotally connected to the discs 34, either radially inwardly or outwardly with respect to the discs 34.

In the embodiment of the invention as shown in FIGS. 2 and 3, the thrust guides 36 are arranged to create a spiral pattern, proceeding from the feed end 44 to the output end 46 of the tanks 12, 14. To create this arrangement, the thrust guides 36 in each successive disc set 32 are offset by a preselected angle in a clockwise direction. This offset angle may range from about 5 degrees to 30 degrees and in one embodiment, an offset angle of 15 degrees was employed. Thus, as shown in FIG. 3, the first thrust guide **36*a* on shaft 22 nearest the feed end 44 and positioned at the top in tank 14 is shown in a vertical position at an angle of 0 degrees in a 360 degree circle while the second thrust guide 36*b* along the shaft 22 is positioned at an angle of 15 degrees relative to the vertical and the third thrust guide 36*c* is positioned at an angle of 30 degrees. This spiral pattern assists in obtaining maximum effectiveness of the thrust guides in circulating and pulverizing the slurry solid materials. The thrust guides 36 on counter rotating shaft 20 may be arranged so as to be offset in a counter clockwise direction, as shown in FIG. 3**. It is also within the scope of the invention for the thrust guides of successive disc sets on the same shaft to be aligned in the same plane in a non-spiral pattern.

In FIG. 2, the thrust guides 36 are shown with the shafts in a counter rotating relationship during operation of the pulverizer 10 and, due to the offset angles at which the thrust guides 36 are mounted, the thrust guides 36 appear in FIG. 2 to become progressively longer or shorter as viewed from above, upon proceeding from the feed end 44 to the outlet end 46. The thrust guides 36 are, however, of equal length as shown in FIG. 3. It is also within the scope of the invention for the size of the discs 34 and the thrust guides 36 to vary along the length of the shafts 20, 22. The freely pivotal mounting of the thrust guides 36 is such that, when the shafts 20, 22 are not rotating, the guides 36 will tend toward a downwardly extending or "limp" position, whereas upon rotation of the shafts 20, 22 during operation, the guides 36 will become fully extended in a radially outwardly direction with respect to the discs 34, as shown in FIG. 3.

The disc sets 32 are arranged in an alternating pattern from feed end 44 to outlet end 46, as shown in FIGS. 2 and 3, so that the first disc set 32 closest to the feed end 44 is on shaft 22 while the next closest disc set 32 to the feed end 44 is on shaft 20 and so on in an alternating relation back and forth from shaft 20 to shaft 22. Also, there is an overlap between the thrust guides 36 of the disc sets 32 carried by the two shafts 20, 22. In one embodiment, the overlap between thrust guides 36 of the two shafts 20 and 22 was in the range of 6 to 8 inches. The effect of the alternating, overlapping pattern is to produce an interdigitating configuration which assists in obtaining maximum circulating and pulverizing action.

Figure 5:
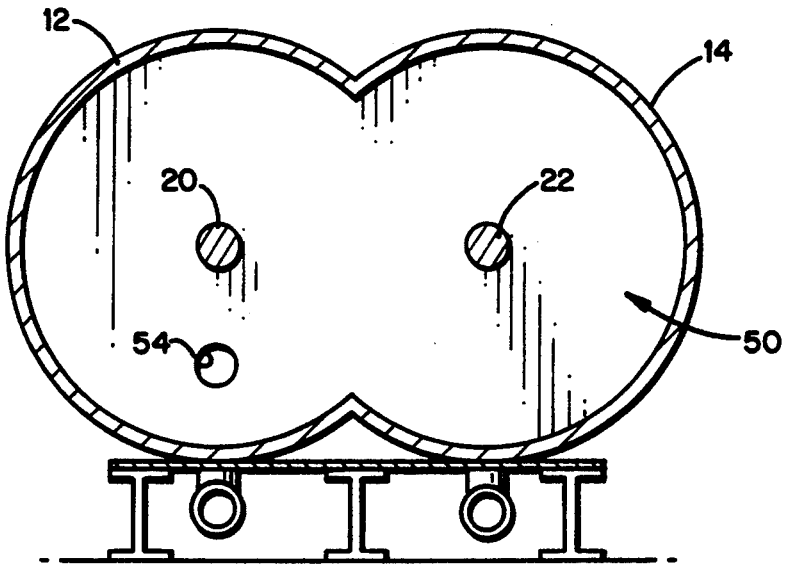
FIG. 5 is an end view of the first baffle configuration of the pulverizer, taken along line 5—5 of FIG. 1.
Figure 6:
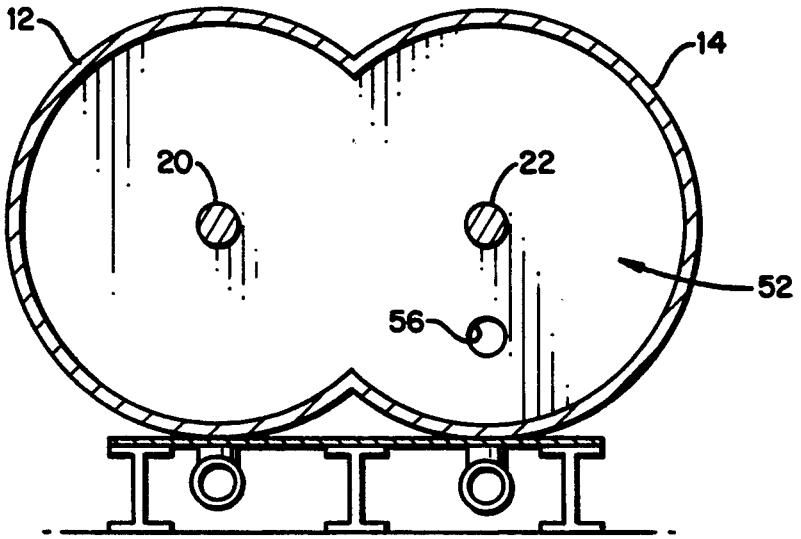
FIG. 6 is an end view of the second baffle configuration, taken along line 6—6 of FIG. 1.
Figure 7:
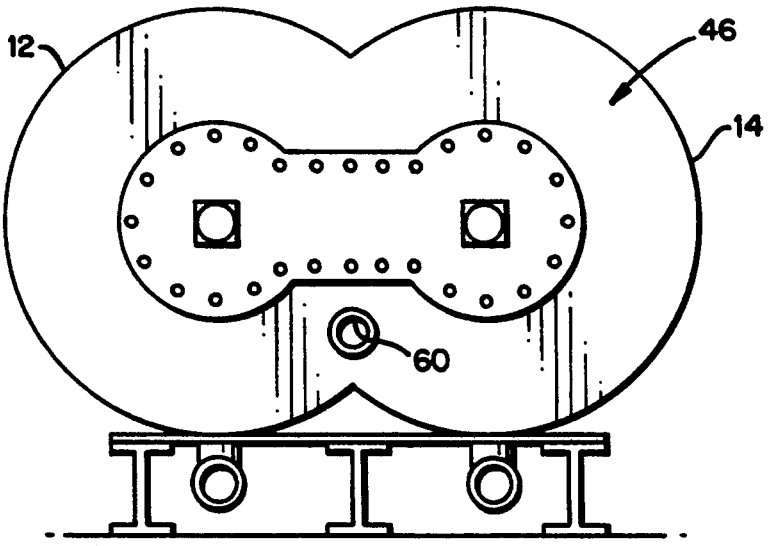
FIG. 7 is an end view of the discharge end of the pulverizer, taken along line 7—7 of FIG. 1.

As shown in FIGS. 1 and 2, the tanks 12 and 14 are divided into separate compartments by baffle walls 50 and 52 which extend transversely across the tanks 12, 14. Each baffle wall 50, 52 is provided with an opening or outlet 54, 56 to allow the feed material to pass through. These outlets 54, 56 are located near the lower end of the walls 50, 52 and are generally at about the same height as the feed inlet 58 in wall 44 and the discharge outlet 60 in outlet wall 46. In one embodiment, as shown in FIGS. 5 through 7, the outlets 54, 56 and 60 in walls 50, 52 and 46, respectively, are of similar size and shape and are staggered in alignment so that outlets 54 and 56 are positioned centrally with respect to the width of respective tanks 12 and 14 while outlet 60 is positioned centrally with respect to the intersection of these tanks 12, 14.

Cleanout holes 62 are located at the bottom of the tanks 12 and 14 to assist in draining the pulverizer 10 when not in use. A cleanout discharge 64 is provided at the outlet end of the pulverizer 10.

In one embodiment of the present invention, the length of the pulverizer 10 is 140 inches, the width 57 inches, and the height 46 inches. However, the pulverizer 10 can range in size up to twice these dimensions or even larger, depending on the requirements of the operating conditions for the machine. The portable size of the pulverizer 10 is an additional benefit.

In operation, material such as drill cuttings from a wellbore is fed into the pulverizer 10 in slurry form through the feed valve 58 at the inlet end of the tanks 12 and 14. Generally, such drill cuttings will contain particles of a size larger than 50 mesh. Once inside the tanks 12 and 14, the particles contained in the drill cuttings are broken up by continual collisions with one another, caused by the action of the counter rotating shafts 20, 22 which turn the disc sets 32 in opposite rotational relation so that the thrust guides 36 carried by shaft 20 interengage with the thrust guides 36 on the other shaft 22 in an overlapping, interdigitating manner, as previously discussed. In one embodiment of the invention, a pair of 75 HP motors 14 are used to run the shafts 20, 22. However, the horsepower may be varied, depending on the size of the pulverizer. Generally, the two shafts 20, 22 will operate at the same rpm, in the range of 1400 to 1900 rpm, so that the thrust guides 36 will rotate fast enough to maintain the rock or other particles in the slurry and allow the solid material in the slurry to impact upon itself rather than dropping out of the slurry.

The action of the thrust guides 36 spins the slurry materials, and forces the slurry solid particles to collide with one another so as to break into smaller pieces. Then, via the liquid slurry medium, the particles flow through baffle outlet 54 into the next compartment of the tanks 12 and 14 for further action by the thrust guides 36. This process continues until the material reaches the material discharge 60 where it then flows out of the tanks 12 and 14 to be used for reinjection into the wellbore. The intermeshing of the thrust guides 36 and their positioning on the disc sets 32 of each shaft 20, 22 act to properly balance the pulverizer 10 when in use so that vibration of the pulverizer 10 is minimal.

Generally, only one pass through the pulverizer 10 is required in order to reduce the cuttings to the desired size. The cuttings are mainly broken up by the continual collisions of the solid particles with one another. This further allows the material to be reduced to the appropriate size after just one pass through the pulverizer.

While the invention has been described as being particularly well suited for use in pulverizing the solid materials in drilling mud and waste from well drilling operations, it is also within the scope of the invention to employ the present apparatus in pulverizing various agricultural products such as pecan shells and various types of minerals.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A pulverizing system for producing finely ground material, comprising:

a tank member formed by a pair of interconnected cylindrical chambers which are in fluid communication and in overlapping relation along the length thereof, said tank having first and second ends, wherein said first end has an inlet for receiving feed material and said second end has a material discharge opening;

a pair of shafts with one shaft being rotatably mounted in each cylindrical chamber;

means for rotating said shafts;

a plurality of disc members mounted on each shaft, at least one of said disc members on each shaft having at least one thrust guide member in the form of an elongated bar or rod pivotally mounted thereon, wherein each of said chambers has substantially smooth, longitudinally extending interior wall surfaces adjacent said at least one thrust guide member of the respective shaft throughout substantially the arc of rotation of said at least one thrust guide member.

2. A pulverizing system for producing finely ground material, comprising:

a tank member formed by a pair of interconnected cylindrical chambers which are in fluid communication and in overlapping relation along the length thereof, said tank having first and second ends, wherein said first end has an inlet for receiving feed material and said second end has a material discharge opening;

a pair of shafts with one shaft being rotatably mounted coaxially in each cylindrical chamber, said shafts extending in parallel relation throughout the length of the chambers;

means for rotating said shafts;

a plurality of disc members mounted on each shaft in position generally transverse to the longitudinal axis of the chambers; and at least one thrust guide member in the form of an elongated bar or rod pivotally mounted on each disc member, wherein each of said chambers has substantially smooth, longitudinally extending interior wall surfaces adjacent at least one thrust guide member throughout substantially the arc of rotation of said at least one thrust guide member of each of said chambers.

3. The pulverizing system of claim 2 wherein said disc members are mounted so that the thrust guides of the respective shafts will overlap and interdigitate in a direction along the longitudinal axis of said shafts.

4. The pulverizing system of claim 2, wherein said tank has at least one baffle wall extending transversely to the longitudinal axis of said tank, thus dividing said tank into a plurality of compartments, said at least one baffle wall having an opening to permit flow of said feed material.

5. The pulverizing system of claim 4, wherein said tank is disposed horizontally and wherein said baffle opening is located in the lower portion of said at least one baffle wall.

6. The pulverizing system of claim 5, wherein said pulverizer tank has a plurality of baffle walls, each wall having an opening therein and wherein the openings in at least two baffle walls are offset relative to each other.

7. The pulverizing system of claim 2, wherein said means for rotating said pair of shafts includes means for rotating said shafts in a counter rotating relation.

8. The pulverizing system of claim 2 wherein at least one disc member is in the form of a pair of discs having at least one thrust guide pivotally mounted between said pair of discs.

9. The pulverizing system of claim 2 wherein the thrust guides on successive disc members of the same shaft are arranged in a spiral pattern.

10. The pulverizing system of claim 2 wherein at least one chamber has substantially smooth, longitudinally extending interior wall surfaces located radially outwardly of at least one pair of adjacent thrust guide members throughout substantially the arc of rotation of said at least one pair of adjacent thrust guide members.

11. The pulverizing system of claim 2 wherein at least one thrust guide member is mounted on its respective disc member at a position which is adjacent to the respective shaft.

* * * * *